US005306532A

United States Patent [19]

Tsien et al.

[11] Patent Number: 5,306,532

[45] Date of Patent: Apr. 26, 1994

[54] KNIFE-PROOF GARMENT MATERIAL WITH PROTRUDED TEXTURE

[76] Inventors: Vee C. Tsien, P.O. Box 73-145; Kuang C. Chang, 131, Sheh Jong St., both of Shyh Lin, Taipei, Taiwan

[21] Appl. No.: 26,294

[22] Filed: Mar. 4, 1993

[51] Int. Cl.[5] ..... B32B 3/10

[52] U.S. Cl. ..... 428/33; 428/53; 428/44; 428/120; 428/911; 89/36.02

[58] Field of Search ..... 420/44, 52, 53, 58, 420/60, 911, 120, 33; 89/36.02

[56] References Cited

U.S. PATENT DOCUMENTS 4,559,251 12/1985 Wachi ..... 428/911

*Primary Examiner*—Alexander S. Thomas

*Attorney, Agent, or Firm*—H. C. Lin

[57] ABSTRACT

A protective garment material is constructed with a matrix of cells with protrusions. These cells are linked with polygonal connecting plates, which have cuts at the corners to form a section of a complete frame for the protrusions. The linkage is formed with aligned semicylindrical flanges extended from the edges of the connecting plate and semicydrical grooves aligned in a different direction serving as sockets for the semicylindrical flanges from a neighboring connecting plate, so that any two neighboring plate can be rotated with respect to each other. The connecting plate also serves as a protective layer for the inner cell in the unprotruded area. The protrusions dirert any frontal thrust sidewise to prevent penetration.

5 Claims, 1 Drawing Sheet

KNIFE-PROOF GARMENT MATERIAL WITH PROTRUDED TEXTURE

BACKGROUND

This invention relates to protective garment against knife attack.

In recent years, the crime rate in the society has unfortunately been increasing. In certain circumstances, such as parks, lonesome trails and dark alleys, rascals or muggers may attack passers-by without any warning. A commonly used weapon is the knife, because it is easy to carry, easy to conceal, easy to make and readily available. Due to its sharpness, the attacker can seriously hurt or kill an innocent person. There is an urgent need to provide some safety clothing to guard against knife attacks, particularly for safety guards, security personnel, and unescorted women.

SUMMARY

An object of this invention is to construct a protective garment against knife attack. Another object of this invention is to construct a protective garment, which is light in weight. Still another object of this invention is to construct a protective garment, which is flexible These objects are obtained by constructing the protective garment material with a matrix of cells with conical protrusions at the center. These cells are flexibly linked together with connecting plates covering over the cells except the protrusions The flexible link is formed by two semicylindrical flanges which extend in alignment from two opposite edges of the connecting plate and mate with two semicylindrical grooves as sockets for two neighboring plates. Meanwhile, two semicylindrical grooves within the same connecting plate orthogonal to the flanges are mated with two other neighboring flanges to serve as sockets. With this construction, the two neighboring plates next to each other can have three degrees of freedom. With adequate clearance between cells in the matrix, loose fit between the cells and the connecting plates, loose fit between the flanges and the grooves, the structure provides flexibility of the garment material. The protrusion diverts any frontal knife penetration sidewise. Together with the double layer outside the protruded area, the structure provides ample protection against knife attack.

DETAILED DESCRIPTION OF THE PREFERRED EMBODIMENT

Figure 1:
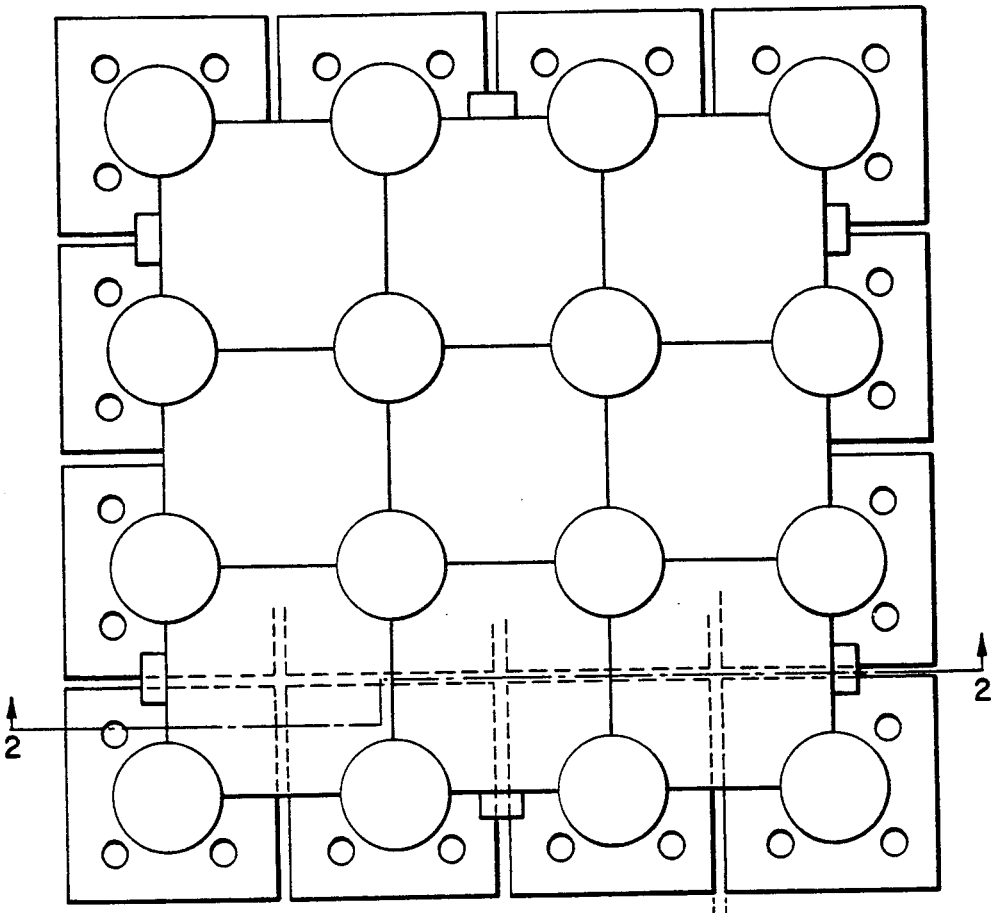
FIG. 1 shows the top view of the textural structure of the present invention including a matrix of elementary cells and connecting plates.
Figure 2:
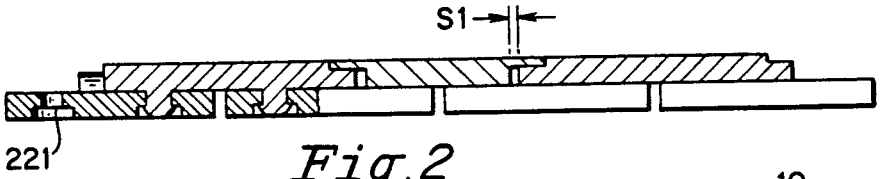
FIG. 2 shows the cross-sectional view of the structure shown in FIG. 1.

The top view of a section of the protective garment material of the present invention is shown in FIG. 1. This material is composed of a large number of elementary cells, such as element 1, connected together by a number of outer plates, such as 10, over these cells. The cross-sectional view of FIG. 1 along the section line 3 is shown in FIG. 2. The placement of these plates are staggered and not aligned with respect to the cells.

Figure 3:
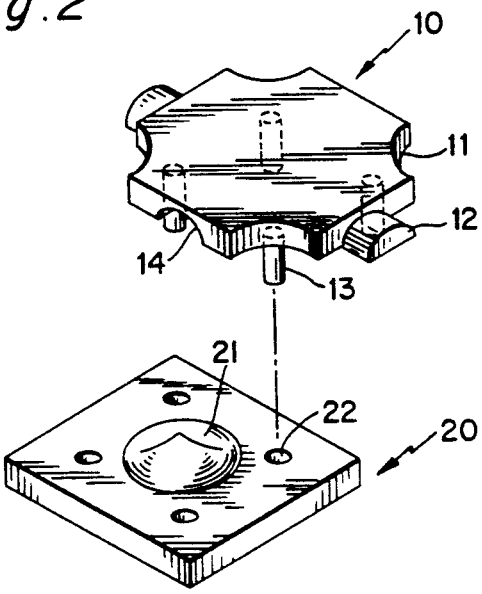
FIG. 3 shows the detailed structure of one cell and its connecting plate.

The structures of the cell and the connecting plate is shown in FIG. 3, denoted as 20 and 10 respectively. The inner cell 20 has a polygon shape. In this example, a 4-sided rectangle is shown as an example. The center portion 21 of the inner cell is protruded in cone-shape. Surrounding the protruded cone are a number of 2-section holes 22 with a smaller diameter section connected to the outer plate and the larger diameter section imbedded against the bottom of the cell to hold the cell and the connecting plate together The cross-sectional view of this kind of holes is shown in FIG. 2 as 221.

The outer plate 10 is square, of appropriate size to match the lower cell 20. The four corners of the outer plate are cut into arcs about the size of a quarter of a circle. Two flanges 12 in semicylindrical shape extended out from two opposite ends of the connecting plate in the horizontal direction. In the orthogonal direction, there are two semicylindrical grooves in the plate serving as sockets to mate with the extended flanges of a neighboring plate. The extended flanges 12 and the grooves 14 are mated in such a way that the resultant surfaces of neighboring plates are normally flat in the same plane but the two neighboring connecting plates can rotate with respect with each other.

On the lower side of the connecting plate are four studs 13, which are aligned with the sectionalized holes 22 in the lower cell 20. The larger diameter section of the stud is imbedded in the bottom of the cells to hold the connecting plates and the cells together as shown by the stud 221 in FIG. 2.

The lower cells are arranged with a slit S2 between them. The placement of the connecting plate is staggered with respect to the lower cell. The recessed arcs of the outer plate surround and form a frame around the protruded cones of the lower cell 20. There is a narrow slit S1 between two neighboring outer plates. This slit allows flexibility between plates. As a garment material, this flexibility makes it more confortable with the two-layered structure and the cone-shaped protrusion, any sharp object is prevented from penetration and is diverted sidewise. Therefore this structure offers excellent protection against knife attacks.

This structure has many advantages:

1. This material is composed of an array of cell elements to offer flexibility for clothing.
2. Due to the double-layered structure pieced together with studs and the semicylindrical linkage of the connecting plates, the structure is very penetration-resistant and flexible.
3. Due to the protrusion in the cell, a frontal attacking knife is diverted sidewise to reduce the forward thrust and to avoid penetration.
4. Due to the slits between neighboring cells and neighboring connecting plates, the clothing material can be contoured to conform with human body figures.
5. Due to the conical shape of the protrusion, the frontal thrust of a knife attack is dissipated by the curved surface.

From the foregoing description, it can be seen that the present invention has many novel features which cannot be found in any prior art.

What is claimed is:

1. A protective garment material against penetration, comprising:

an array of cells, each having a protrusion which is cone-shaped;

multiple number of connecting plates placed over said cells for connecting neighboring said cells, said connecting plates having a shape to conform a section of a complete frame for said protrusion, and to cover areas of each said cell other than said protrusion as an additional protective layer;

means for holding the cells and the connecting plates together.

2. A protective garment material as described in claim 1, wherein said connecting plates have cuts in said shape to frame said protrusion and have the contour of a rectangle.

3. A protective garment material as described in claim 2, wherein each one of said connecting plates has a rectangular outline.

4. A protective garment material as described in claim 2, wherein said rectangle is square.

5. A protective garment material as described in claim 2, wherein each one of said cuts has the contour of an arc and pieces together with other said cuts to form a circle.

* * * * *